United States Patent [19]

Zakiewicz

[11] 4,249,775

[45] Feb. 10, 1981

[54] MINING OF SULPHUR

[75] Inventor: Bohdan M. Zakiewicz, London, England

[73] Assignee: British Sulphur Corp., Ltd., London, England

[21] Appl. No.: 4,198

[22] Filed: Jan. 17, 1979

[30] Foreign Application Priority Data

Jan. 18, 1978 [GB] United Kingdom ..... 2074/78

[51] Int. Cl.[3] ..... E21B 43/28

[52] U.S. Cl. ..... 299/4; 299/6

[58] Field of Search ..... 299/4–6

[56] References Cited

U.S. PATENT DOCUMENTS

| | | | |
|---|---|---|---|
| 1,602,475 | 10/1926 | Andrews | 299/6 X |
| 1,750,136 | 3/1930 | Schroeder | 299/6 |
| 2,137,619 | 11/1938 | Lee | 299/6 |
| 2,808,248 | 10/1957 | Prokop et al. | 299/6 |
| 2,896,932 | 7/1959 | Marquis | 299/4 |
| 3,205,012 | 9/1965 | Dancy | 299/6 X |

*Primary Examiner*—William F. Pate, III

*Attorney, Agent, or Firm*—Howard L. Rose

[57] ABSTRACT

A method of mining sulphur from an underground deposit overlying a soluble salt layer, wherein spaced parallel rows of repression boreholes and depression boreholes are drilled to penetrate into the salt layer, production boreholes are provided in a row intermediate the repression and depression boreholes, hot water or brine is introduced to the salt layer through the repression boreholes to create a superheated salt solution which is directed into the sulphur deposit, brine is pumped out through the depression boreholes thereby causing a flow of hot brine through the sulphur deposit from the repression to the depression boreholes which melts and entrains sulphur, and this molten sulphur is pumped up through the production boreholes. Hot water or brine is also introduced through the production boreholes to keep sulphur filters at the lower ends of the production boreholes clear.

11 Claims, 2 Drawing Figures

MINING OF SULPHUR

This invention relates to deep underground mining of sulphur from underground deposits and in particular non-isolated dome-type sulphur deposits.

One traditional method of mining sulphur is the Frasch method. In this method a borehole is drilled down to the sulphur bearing stratum and then superheated water is injected down the borehole to melt the sulphur which is then forced to the surface as a liquid. This method is only suitable for use with isolated dome-type sulphur deposits and like deposits where significant losses of the hot water can be avoided. Additionally the maximum amount of sulphur which can be recovered from the deposit is usually no higher than 70% and is often much less.

It is therefore an object of this invention to provide a method of mining sulphur which can be used on non-isolated dome-type deposits and by means of which a high proportion of the sulphur can be recovered from the deposit.

According to the invention there is provided a method of mining sulphur from an underground deposit which overlays a soluble salt layer, wherein hot water or brine is passed down through at least one repression borehole which extends through the sulphur deposit into the underlying soluble salt layer thereby creating a superheated salt solution which is then directed into the sulphur deposit, brine is removed from at least one depression borehole at a location spaced from the repression borehole whereby the hot salt solution filters across from the repression borehole to the depression borehole through an intervening region of the sulphur deposit between said repression and depression boreholes and melts and entrains molten sulphur in that region, and molten sulphur so formed is piped up to the surface from said region. A repression borehole is a pressurising borehole down which hot water or brine is pumped under pressure. A depression borehole is a depressurising borehole up which water or brine is pumped to the surface.

Preferably, a plurality of repression boreholes and a plurality of depression boreholes are drilled in two spaced approximately parallel rows, and the molten sulphur is raised through a row of production boreholes placed between the repression and depression boreholes.

Because the brine tends to move in the direction of the depression boreholes this sweeps most of the sulphur from the deposit towards the production boreholes. Therefore a very high proportion of the sulphur can be recovered from the deposit. In practice one can recover 85% or more of the sulphur which makes it possible to use the method of the invention to recover further sulphur from a deposit which has already been worked by the Frasch method. The saturated salt solution which is formed cools slightly as it passes towards the depression boreholes but cools to a larger extent if it passes in any other direction. Therefore salt is crystallised out of solution and this forms a barrier in the sulphur stratum which substantially reduces the amount of hot water which is lost.

The point of maximum saturation is desirably maintained at temperatures ranging from 280° to 310°0 F. while regulating the brine cooling process in the sulphur orebody in such a way as to prevent seepage of the brine out of the exploitation area by causing part of the dissolved sodium chloride to be precipitated from the oversaturated solution around the cooler perimeter of that area, creating a temporary water-tight screen of salt. Therefore the method of the invention can be used to recover sulphur from spatially non-isolated dome-type sulphur deposits as well as other types of sulphur deposit. Also the location of the temporary water-tight screen of salt can be raised as the area of mining is advanced, e.g., by boring a further row of depression boreholes, and using the production boreholes and former depression boreholes as repression boreholes and production boreholes respectively. Therefore the sulphur deposit is exploited in successive elongated belts.

The main flow of brine is desirably so saturated with a salt such as sodium chloride that its high specific gravity, compared with that of the natural ground water, enables it to be directed through the base of the sulphur zone causing extensive melting of the sulphur therein across the entire vertical cross-section of the sulphur bed. The sulphur is therefore directed to the production boreholes which are preferably arranged in rows parallel to the repression boreholes, both brine and molten sulphur thereby being caused to flow in the desired direction.

The brine removed from the depression boreholes is preferably recirculated to save heat and to provide a strong brine which after reheating and injection through to repression boreholes is then subjected to helical processing in contact with salt to ensure total supersaturation with the salt. Also by maintaining a strong brine at all times, this reduces scaling in heat exchangers and other units since brine saturated with sodium and potassium chlorides has anti-scaling properties.

The whole method of the invention can be subjected to continuous overall control and computer analysis, permitting the construction of a dynamic model of the exploitation system which can be further optimised by using iterative statistical computations.

The invention will now be illustrated by way of example, with reference to the accompanying diagrammatic drawings in which.

Figure 1:
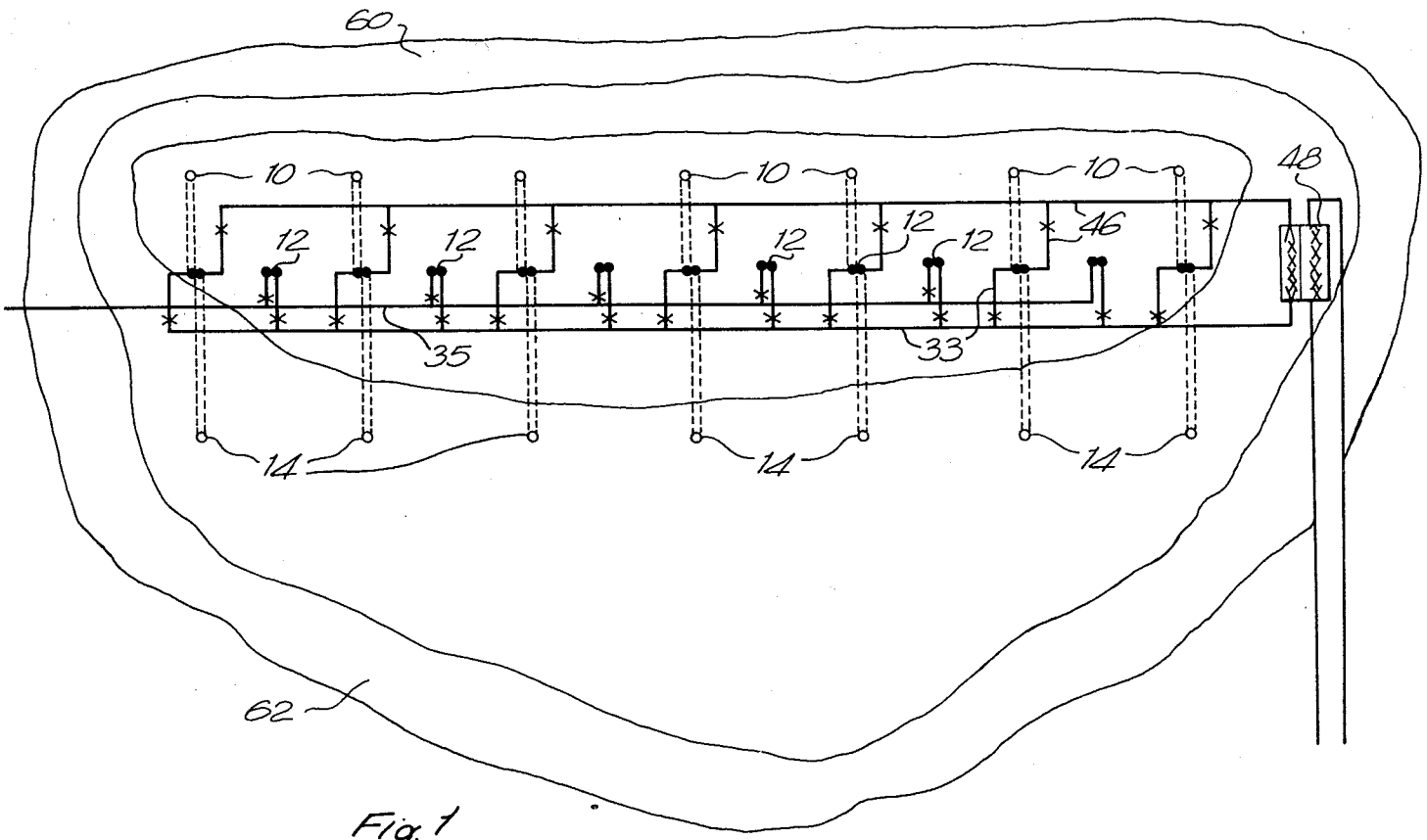
FIG. 1 shows a plan of an arrangement of boreholes.

Several substantially parallel rows of boreholes are drilled. In the example shown there are a row of repression boreholes 10, an intermediate row of production boreholes 12 and a row of depression boreholes 14. The boreholes extend down through the overburden 16 to the sulphur ore bed 18. The repression boreholes and depression boreholes extend completely through the bed 18 and down into a salt massif 20 beneath the bed 18.

The repression boreholes 10 are equipped with outlet nozzles 22 in the lower part of the repression pipe, by means of which brine under repression pressure intensively washes the salt massif 20 in the salt chamber 24 around the nozzles 22 and becomes further saturated with washed salt. It then passes up into the protective casing 28 around the borehole pipe 29 and out through filter apertures 26 in the casing 28 into the overlying sulphur ore bed 18.

The production boreholes 12 are each furnished, in the lower part of the protective casing 30, at the level of the sulphur ore bed 18, with an anti-plugging filter, which is heated along its entire vertical profile by brine previously raised to temperatures of 280° to 310° F. The number of filter openings required for circulating the brine is so selected as to prevent an excessive flow of brine into the ore layer and an expulsion of sulphur into the near-filter and exploitation zones.

The production boreholes 12 are characterised by vertical reinforcement usually consisting of two small-diameter pipelines, one of which pipelines 31 supplies the borehole with superheated brine required to heat the sulphur filter, while the other is a sulphur uptake pipeline 34 delivering molten sulphur to a surface product line 35. A submersible delivery pump 36 is immersed in the hydrostatic column of molten sulphur in each pipeline 34.

The depression boreholes 14 are each furnished with an inlet filter 38 in the protective casing 39 at the level of the sulphurised zone, through which brine passes from the sulphur ore bed 18 downward to a salt chamber 40 in the salt massif 20 and thence, after further saturation with salt, is pumped through a filter 42 into an uptake pipeline 44. The upper ends of the pipelines 44 connect with recirculation pipelines 46 conducting the brine 31 to a heat exchanger 48 whence it is returned via pipes 33 to the downtake pipes 29, 31 in the repression boreholes 10 and production boreholes 12, the entire recirculation being carried out by submersible pumps 50 installed in the depression boreholes.

The downtake and uptake pipes for the repression, production and depression boreholes will be equipped, at the surface, with devices for measuring and controlling flow, pressure, temperature and chemical composition of the production media. These devices are further provided, in addition to gauges, with telemetric transmitters by means of which the operating parameters are signalled directly to a computer and processed for production control based on the computerised optimisation of the entire process.

The ground-level horizontal pipelines carrying brine and molten sulphur can, if required, be joined into a single bundle having common insulation, thereby giving additional heat exchange.

Figure 2:
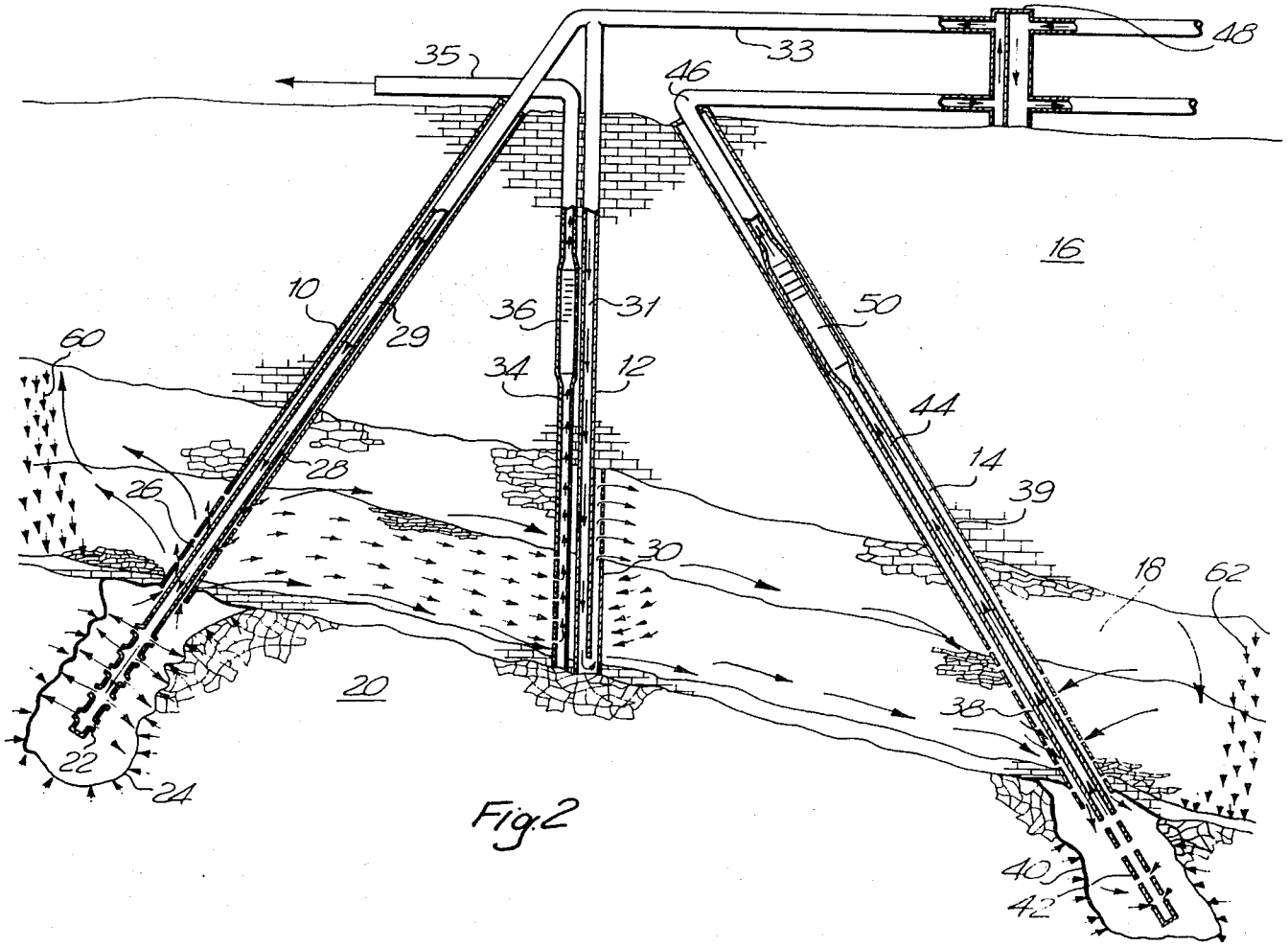
FIG. 2 is a section through a sulphur deposit.

As best shown in FIG. 2, the brine flows in the general direction from the repression boreholes 10 to the production boreholes 12 and then on to the depression boreholes 14. The hot brine melts the sulphur in the ore 18 and entrains this as it flows towards the production boreholes from the repression boreholes, and by means of this largely unidirectional flow a very high proportion of the sulphur is swept from the ore. Any brine which tries to flow from the repression boreholes in the direction away from the production boreholes will cool and deposit salt from the saturated solution as a temporary salt wall 60. This wall then prevents further significant loss of hot brine. Similarly, brine which flows from the repression and production boreholes past the depression boreholes also cools sufficiently to deposit a temporary salt wall 62. These walls 60 and 62, as best shown in FIG. 1, combine to define a roughly oval area within which the sulphur is mined and the brine flow occurs.

A considerable advantage of using brine as a medium for extraction of the sulphur is that salt (NaCl) effectively controls fouling of heat exchangers and pipes by anhydrite scale.

I claim:

1. A method of mining sulphur from an underground deposit which overlays a soluble salt layer, wherein hot water or brine is passed down through at least one pressurising borehole which extends through the sulphur deposit into the underlying soluble salt layer thereby creating a superheated salt solution which is then directed into the sulphur deposit, brine is removed from at least one depressurising borehole at a location spaced from the pressurising borehole whereby the hot salt solution filters laterally from the pressurising borehole to the depressurising borehole through an intervening region of the sulphur deposit between said pressurising and depressurising boreholes and entrains molten sulphur in that region, and molten sulphur so formed is piped up to the surface from said region through at least one production borehole located between the pressurising and depressurising boreholes.

2. A method according to claim 1, wherein a plurality of pressurising boreholes and a plurality of depressurising boreholes are drilled in two spaced approximately parallel rows, and the molten sulphur is raised through a row of production boreholes placed between the pressurising and depressurising boreholes.

3. A method according to claim 1 or claim 2, wherein the hot water or brine is passed down to the salt layer through a pipe in the pressurising borehole which has outlet nozzles on the portion of it that penetrates the salt layer, and the superheated salt solution formed within the salt layer enters the space between the borehole casing and the pipe and flows out into the sulphur deposit through apertures in the casing at the sulphur deposit level.

4. A method according to claim 1 or claim 2, wherein brine is removed from the salt layer through an uptake pipe in the depressurising borehole which pipe terminates in a filter at its end section penetrating the salt layer, and the brine flows to said filter by re-entering the salt layer through the space between the pipe and the casing of the depressurising borehole said casing having apertures at the sulphur deposit level to admit the brine.

5. A method according to claim 4, wherein the brine is pumped up the depressurising borehole pipe by a submersible pump in the borehole.

6. A method according to claim 1 or claim 2, wherein the molten sulphur enters the molten sulphur uptake pipe through a sulphur filter at the lower end section of the pipe that penetrates the sulphur deposit, and to keep the sulphur filter clear hot brine is passed down to it through a brine downtake pipe alongside the sulphur uptake pipe.

7. A method according to claim 6, wherein the molten sulphur is pumped to the surface by a submersible pump in the uptake pipe.

8. A method according to claim 1, wherein the brine withdrawn from the depressurising borehole is heated in heat exchange means and recirculated to the pressurising borehole or to both the pressurising and the production boreholes.

9. A method according to claim 8, wherein the brine is heated to a temperature of 280° to 310° F.

10. A method according to claim 1 or claim 2, wherein seepage of brine out of the exploitation region is prevented by causing sodium chloride to precipitate out as the brine reaches the cooler regions of the sulphur deposit to form a temporary screen of salt.

11. A method according to claim 2 wherein the sulphur deposit is exploited in successive elongated belts by boring a further row of depressurising boreholes, using the former production boreholes and depressurising boreholes as pressurising boreholes and production boreholes, respectively, and repeating the process.

* * * * *